US010023439B2

(12) United States Patent
Jussila et al.

(10) Patent No.: US 10,023,439 B2
(45) Date of Patent: Jul. 17, 2018

(54) METHOD FOR DETECTING OVER CONNECTED ACCESS COVER PLATE

(71) Applicant: KONE Corporation, Helsinki (FI)

(72) Inventors: Ari Jussila, Helsinki (FI); Toni Hirvonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/726,557

(22) Filed: Oct. 6, 2017

(65) Prior Publication Data

US 2018/0141784 A1 May 24, 2018

(30) Foreign Application Priority Data

Nov. 21, 2016 (FI) ..... 20165875

(51) Int. Cl.

| | |
|---|---|
| ***B66B 25/00*** | (2006.01) |
| ***B66B 29/00*** | (2006.01) |
| ***B66B 27/00*** | (2006.01) |
| ***B66B 23/00*** | (2006.01) |

(52) U.S. Cl.

CPC ..... *B66B 25/006* (2013.01); *B66B 23/00* (2013.01); *B66B 27/00* (2013.01); *B66B 29/005* (2013.01)

(58) Field of Classification Search

CPC ..... B66B 23/00; B66B 25/00; B66B 25/006; B66B 27/00; B66B 29/00; B66B 29/005; B66B 29/06; B66B 31/00

USPC ..... 198/321, 323, 324, 325

See application file for complete search history.

(56) References Cited

U.S. PATENT DOCUMENTS 6,142,286 A * 11/2000 Ulrich ..... B66B 29/06 198/325
6,189,673 B1 * 2/2001 Lee ..... B66B 23/00 198/324
6,685,002 B1 * 2/2004 Nurnberg ..... B66B 21/00 198/321

(Continued)

FOREIGN PATENT DOCUMENTS

JP 55-101867 U 7/1980
JP 6-219677 A 8/1994

(Continued)

OTHER PUBLICATIONS

Office Action issued in Finnish Patent Application No. 20165875, dated May 3, 2017.

(Continued)

*Primary Examiner* — Leslie A Nicholson, III
*Assistant Examiner* — Keith R Campbell
(74) *Attorney, Agent, or Firm* — Birch, Stewart, Kolasch & Birch, LLP

(57) ABSTRACT

An escalator system includes a pit having an access cover plate, a detector indicating when the access cover plate is open and when it is closed, and a user interface which is located in said pit and which in an active state provides the escalator system with control signals controlling the operation of the escalator and which in a passive state does not affect the operation of the escalator. In order to improve the safety of the escalator system the escalator system is configured to stop movement of the escalator if the detector indicates that the access cover plate is closed while the user interface is in the active state.

20 Claims, 1 Drawing Sheet

(56) References Cited

U.S. PATENT DOCUMENTS

| | | | | |
|---|---|---|---|---|
| 6,848,562 | B2 * | 2/2005 | Viola | B66B 31/00 198/321 |
| 8,365,897 | B2 * | 2/2013 | Besnard | B66B 29/06 198/322 |
| 2018/0029842 | A1 * | 2/2018 | Li | B66B 21/02 |

FOREIGN PATENT DOCUMENTS

| | | | | |
|---|---|---|---|---|
| JP | 2005-1805 | A | | 1/2005 |
| JP | 2008-001467 | A | | 1/2008 |
| JP | 2008001467 | A | * | 1/2008 |
| JP | 2014-108833 | A | | 6/2014 |
| JP | 2015-051839 | A | | 3/2015 |
| JP | 2015-101461 | A | | 6/2015 |
| WO | WO 2011/023846 | A1 | | 3/2011 |

OTHER PUBLICATIONS

Search Report issued in Finnish Patent Application No. 20165875, dated May 3, 2017.

European Notification of European publication No. and information on the application of Article 67(3) EPC dated Apr. 25, 2018 and Extended European Search Report dated Apr. 13, 2018 for European Application No. 17200770.0.

* cited by examiner

METHOD FOR DETECTING OVER CONNECTED ACCESS COVER PLATE

BACKGROUND OF THE INVENTION

Field of the Invention

This invention relates to an escalator system and in particular to a solution for improving the safety of an escalator system.

Description of Prior Art

Previously there is known an escalator system with a first pit in a first end of the escalator and with a second pit in a second end of the escalator. Various technical devices needed for driving the escalator are arranged in the first pit and in the second pit. Consequently service technicians need to have access to the first and second pit. This access is provided such that the service technician is able to access the first and second pit by opening the access cover plate covering the first or second pit, depending on to which pit access is needed.

The access cover plate of the respective first and second pit is in praxis arranged as an extension of the escalator. Consequently, when users are utilizing the escalator, they walk over the access cover plates of the first and second pit when entering the escalator or exiting the escalator. Therefore, in order to prevent that a person using the escalator falls into the pit due to the fact that the access cover plate is not appropriately closed, it is very important to ensure that the access cover plate is closed during use of the escalator. To ensure that the access cover plate is appropriately closed during use of the escalator, the known escalator is provided with a detector which indicates when the access cover plate is open and when it is closed.

There exists a safety risk with the known solution in case the escalator system does not receive a correct indication from the detector, as this involves the risk that the access cover plate may accidentally be left in such a position that it is not appropriately closed when the escalator is taken into ordinary use. In such a situation the detector does not give the correct indication which would be needed to prevent driving of the escalator.

SUMMARY OF THE INVENTION

An object of the present invention is to improve the safety of an escalator system. This object is achieved with an escalator system according to independent claim 1 and with a method according to independent claim 9.

A solution where movement of the escalator is stopped when the access cover plate is closed while the user interface is in the active state improves the safety by eliminating the risk that the escalator is used while the detector does not give a correct indication to the escalator system about the position of the access cover plate.

Preferred embodiments of the invention are disclosed in the dependent claims.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
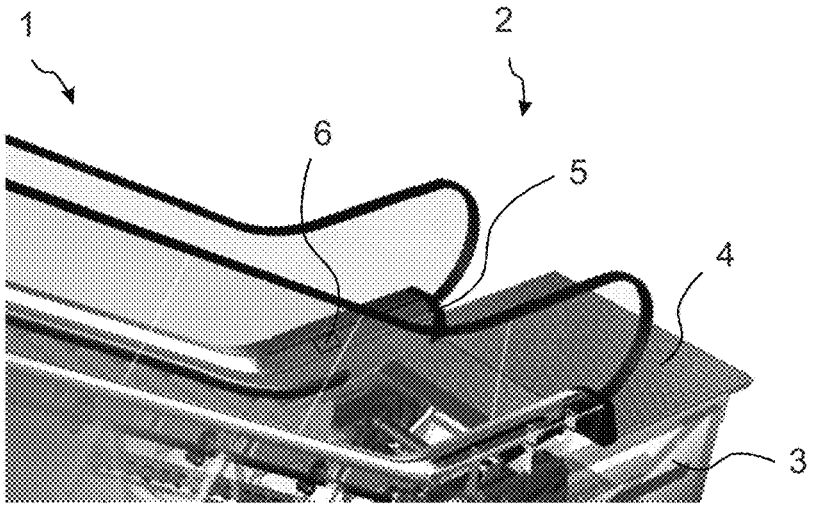
FIG. 1 illustrates a part of an escalator system.
Figure 2:
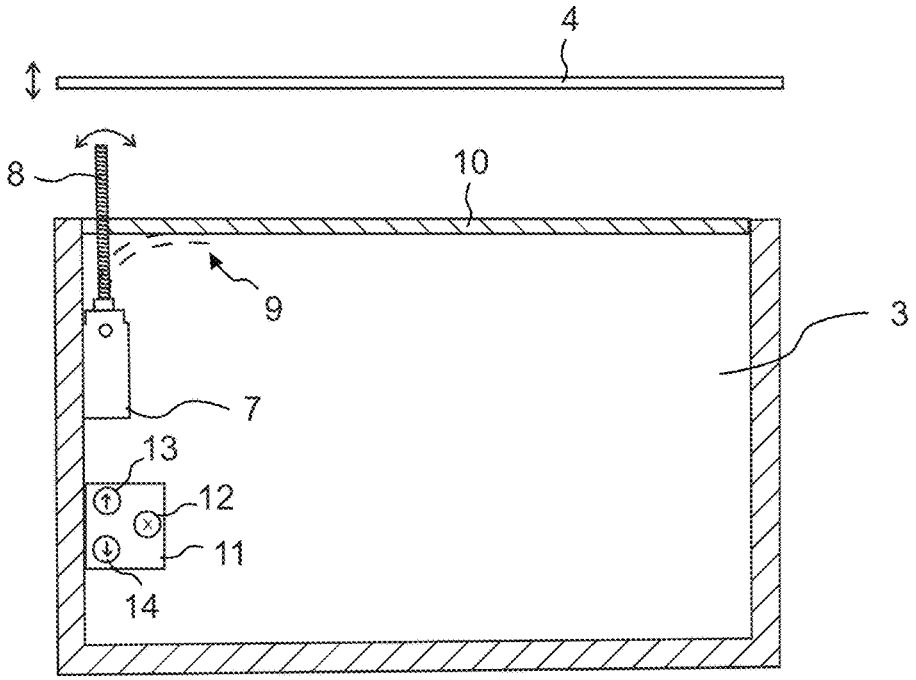
FIG. 2 illustrates a pit of the escalator system of FIG. 1 in cross-section.

FIGS. 1 and 2 illustrate an embodiment of an escalator system 1. A first end 2 of the escalator is provided with a pit 3 as an extension of the escalator. In this way person using the escalator will walk over the pit when entering or exiting the escalator. A similar pit may be arranged also in the opposite second end of the escalator.

As illustrated by way of example in FIG. 1, the first end 2 of the escalator is the lower end, while the second opposite end (not illustrated) of the escalator is the upper end of the escalator. Consequently, in this example the escalator extends between different floors of a building, for instance. Alternatively the first end and the second end of the escalator may be both arranged on the same floor, in which case the escalator can be used for transporting persons from one location to another while remaining on one single floor. In this application the term "escalator" includes also moving ramps and autowalks, in other words people conveyers arranged in one single floor only or to extend between different floors.

FIG. 1 illustrates the first end 2 of the escalator with an access cover plate 4 in a closed position, in other words in a position where the access cover plate 4 covers the pit 3 in such a way that persons using the escalator are prevented from falling into the pit 3.

The escalator is provided with a control panel 6. Via this control panel the escalator can be driven in a normal operation mode, also referred to as an automatic mode. Consequently, a person responsible for operating the escalator can during daily use via this control panel stop the escalator and also control it to run in a first direction (such as upwards) and in a second opposite direction (such as downwards). The exact location of the control panel may vary. In the figures the control panel is by way of example located in a frame 5 of the escalator. In case the escalator system via the respective detectors detects that the access cover plate 6 in the first end 2 or that the access cover plate in the second end of the escalator is in an open position, the escalator system prevents driving of the escalator in the normal mode.

FIG. 2 illustrates the pit 3 in cross-section. For simplicity, the devices contained in the pit are not illustrated in FIG. 2. In the illustrated example the pit 3 is provided with a detector 7 detecting the position of the access cover plate 4. In this example the detector 12 is implemented as switch with a spring 8 which can be bent sideways. When the access cover plate 4 is in closed position, the access cover plate 8 is in contact with this spring 8 such that it is bent sideways, and once the access cover plate 4 is in an open position, in other words in the illustrated position, the spring force returns the spring 8 to the illustrated straight upright position. The spring 8 is provided with electrical contacts indicating the position of the spring such that the escalator system can be provided with information about the position of the access cover plate 8, as previously explained.

A problem involved with using a detector 7 of the illustrated type is that the detector may be stuck in a position where the escalator system continuously receives an indication according to which the access cover plate 4 is closed. This may be the case if the spring 8 is wedged under the frame 10 of the pit 3, as illustrated at arrow 9. Alternatively there may be a problem with the electrical wiring of the detector 7 or a malfunction in the detector itself.

In the illustrated escalator system the detector 7 indicates when the access cover plate 4 is open and when it is closed. This indication is provided to a control unit of the escalator, for instance. Such a control unit (not illustrated) may be implemented with circuitry or a combination of circuitry and software, for instance. The control unit controls the electric motor which drives the escalator, for instance. For this purpose the detector 7 may be a simple switch which via braking and closing an electric circuit informs the control unit of the escalator system of the position of the cover plate 4. Alternatively, the detector 7 may be implemented with circuitry capable of communicating the position of the cover plate 4 to the control unit via a computer bus, according to the PESSRAE standard, for instance.

A user interface 11 is located in the pit 3. This user interface provides a service technician a possibility of controlling driving of the escalator from the pit 3, in which case the user interface may be an inspection mode user interface offering the service technician a possibility to drive the escalator in an inspection mode. In an active state this user interface 11 provides the escalator system, such as the control unit of the escalator, with control signals controlling the operation of the escalator. While being in a passive state, the user interface does not affect the operation of the escalator.

In the illustrated example the escalator system is configured to stop movement of the escalator if the detector 7 indicates that the access cover plate is closed while the user interface is in the active state. During normal maintenance work the access cover 4 should in practice always be open when the service technician drives the escalator via the user interface 11 (which then is active). A situation where the service technician is located inside the pit 3 with the access cover closed should not occur. Therefore if the detector 8 indicates that the access cover 4 is closed while the user interface 11 is active, this is a clear indication of the fact that the detector 7 does not work correctly. In such a situation the safety is ensured by stopping the escalator. This stopping may in praxis be implemented by the control unit of the escalator which detects the situation.

In order to ensure safety after the escalator has been stopped due to the reason mentioned above, the escalator system preferably maintains the escalator in the stopped position until the detector 7 indicates that the access cover plate 10 is opened while the user interface 11 is in the passive state. Only after this, the user interface may again be used for controlling driving of the escalator.

In FIG. 2 it has by way of example been assumed that the user interface comprises push buttons or push button areas (in case of a touch screen) offering a user a possibility to via the user interface 11 provide the escalator with control signals. FIG. 2 shows a stop button 12, a button 13 for movement in a first direction and button 14 for movement in a second direction. In addition, the user interface may have an additional button for activating the user interface, such as a power button switching on electrical feed to the user interface, for instance. Pushing any of the push buttons or push button areas mentioned above activates the user interface in a way which the escalator system detects.

As an alternative to the user interface illustrated in FIG. 2, the pit 3 may instead be provided with an electrical socket only, which works as the user interface. In that case the service technician may have available a portable operating panel which can be detachably connected to the electric socket. In that case the above explained push buttons or push button areas may be implemented in the portable operating panel. With such a detachable solution, connecting of the portable device to the electric socket or alternatively detaching a blind plug from the electric socket to facilitate such connecting, may trigger activation of the user interface 11. Similarly, once the portable device is detached from the electric socket or the blind plug is reattached to the electric socket, deactivation of the user interface is indicated to the escalator system.

It is to be understood that the above description and the accompanying figures are only intended to illustrate the present invention. It will be obvious to a person skilled in the art that the invention can be varied and modified without departing from the scope of the invention.

The invention claimed is:

1. An escalator system comprising:

a pit in at least a first or a second end of the escalator, said pit having an access cover plate, a detector indicating when the access cover plate is open and when the access cover plate is closed, and a user interface which is located in said pit and which in an active state provides the escalator system with control signals controlling the operation of the escalator and which in a passive state does not affect the operation of the escalator, wherein the escalator system is configured to stop movement of the escalator if the detector indicates that the access cover plate is closed while the user interface is in the active state.

2. The escalator system of claim 1, wherein the escalator system is configured to maintain the escalator, once stopped, in the stopped position until the detector indicates that the access cover plate is opened while the user interface is in the passive state.

3. The escalator system according to claim 1, wherein the user interface comprises push buttons or push button areas offering a user a possibility to, via the user interface, provide the escalator with control signals.

4. The escalator system according to claim 1, wherein the escalator system detects that the user interface is in the active state when the escalator system receives from the user interface control signals indicating stop, movement in a first direction, movement in a second direction or an activation signal indicating that a user has activated the user interface.

5. The escalator system according to claim 1, wherein the user interface comprises an electric socket and a portable operating panel which is detachably connected to the electric socket.

6. The escalator system according to claim 1, wherein the detector indicates when the access cover plate is open and when it is closed via a computer bus according to PESSRAE standard.

7. The escalator system according to claim 1, wherein the user interface is an inspection mode input.

8. The escalator system according to claim 1, wherein the escalator system is provided with a control panel for driving the escalator in a normal operation mode, and the user interface is a user interface for driving the escalator in an inspection mode.

9. The escalator system according to claim 2, wherein the user interface comprises push buttons or push button areas offering a user a possibility to via the user interface provide the escalator with control signals.

10. The escalator system according to claim 2, wherein the escalator system detects that the user interface is in the active state when the escalator system receives from the user interface control signals indicating stop, movement in a first direction, movement in a second direction or an activation signal indicating that a user has activated the user interface.

11. The escalator system according to claim 3, wherein the escalator system detects that the user interface is in the active state when the escalator system receives from the user interface control signals indicating stop, movement in a first direction, movement in a second direction or an activation signal indicating that a user has activated the user interface.

12. The escalator system according to claim 2, wherein the user interface comprises an electric socket and a portable operating panel which is detachably connected to the electric socket.

13. The escalator system according to claim 3, wherein the user interface comprises an electric socket and a portable operating panel which is detachably connected to the electric socket.

14. The escalator system according to claim 4, wherein the user interface comprises an electric socket and a portable operating panel which is detachably connected to the electric socket.

15. The escalator system according to claim 2, wherein the detector indicates when the access cover plate is open and when it is closed via a computer bus according to PESSRAE standard.

16. The escalator system according to claim 3, wherein the detector indicates when the access cover plate is open and when it is closed via a computer bus according to PESSRAE standard.

17. The escalator system according to claim 4, wherein the detector indicates when the access cover plate is open and when it is closed via a computer bus according to PESSRAE standard.

18. The escalator system according to claim 5, wherein the detector indicates when the access cover plate is open and when it is closed via a computer bus according to PESSRAE standard.

19. A method for operating an escalator system, wherein the method comprises:

activating a user interface located in a pit in a first end or a second end of an escalator to an active state to provide the escalator system with control signals controlling the operation of the escalator, detecting via a detector if an access cover plate of the pit is open or closed, and stopping movement of the escalator if the detector indicates that the access cover plate is closed when the user interface is in the active state.

20. The method of claim 19, wherein the method comprises:

maintaining the escalator, once stopped, in the stopped position until the detector indicates that the access cover plate is opened while the user interface is in a passive state.

* * * * *